United States Patent [19]

Mori et al.

[11] Patent Number: 4,783,219

[45] Date of Patent: Nov. 8, 1988

[54] METHOD FOR MELTING AND REDUCING CHROME ORE

[75] Inventors: Hajime Mori; Minoru Hirano; Teruyuki Hasegawa; Yoshihiko Kawai; Yoshiteru Kikuchi; Kenji Takahashi, all of Tokyo, Japan

[73] Assignee: Nippon Kokan Kabushiki Kaisha, Tokyo, Japan

[21] Appl. No.: 929,171

[22] Filed: Nov. 10, 1986

[30] Foreign Application Priority Data

Nov. 13, 1985 [JP] Japan ..... 60-252635

[51] Int. Cl.[4] ..... C21C 5/34

[52] U.S. Cl. ..... 75/62; 75/49; 75/59.19; 75/59.21

[58] Field of Search ..... 75/49, 59.2, 62, 59.15, 75/59.19

[56] References Cited

U.S. PATENT DOCUMENTS

| | | | |
|---|---|---|---|
| 3,046,107 | 7/1962 | Nelson | 75/59.15 |
| 3,252,790 | 5/1966 | Krivsky | 75/59.24 |
| 3,773,496 | 11/1973 | Kruppel | 75/59.2 |
| 3,844,768 | 10/1974 | Leroy | 75/59.2 |
| 3,854,932 | 12/1974 | Bishop | 75/49 |
| 4,178,173 | 12/1979 | Gorges | 75/59.2 |
| 4,497,656 | 2/1985 | Robert | 75/59.19 |
| 4,497,656 | 2/1985 | Robert | 75/59.19 |

FOREIGN PATENT DOCUMENTS 0079182 5/1983 European Pat. Off. .

*Primary Examiner*—Peter D. Rosenberg

*Attorney, Agent, or Firm*—Frishauf, Holtz, Goodman & Woodward

[57] ABSTRACT

A method for melting and reducing chrome ore, which comprises charging chrome ore and carbonaceous material, and blowing in oxygen gas under a pressure ranging from 1 to 600 Torr, while molten metal is being stirred by a stirring gas blown in. In this method, a reaction vessel capable of allowing top blowing and bottom blowing onto the molten metal and decreasing pressure within the vessel is employed. Chrome ore and carbonaceous material can be used in the form of lumps or powder. When powdered ore and material are used, they can be injected through a lance or a tuyere into the vessel.

14 Claims, 5 Drawing Sheets

METHOD FOR MELTING AND REDUCING CHROME ORE

BACKGROUND OF THE INVENTION

1. Field of the Invention

The present invention relates to a method for melting and reducing chrome ore, and more particularly, to a method for melting and reducing chrome ore by charging in chrome ore and carbonaceous material, and blowing oxygen gas onto the molten metal.

2. Description of the Prior Art

Recently, various methods for melting and reducing chrome ore have been proposed. Japanese Patent Laid Open No. 159963/84, for example, describes a method wherein:

(a) Powder of chrome oxides is injected by carrier oxidizing gas being blown onto the molten metal;

(b) Carbonaceous material, for example, coal or coke, and gases for stirring, are supplied; and (c) Through the process of reduction, achieved in steps (a) and (b), molten metal containing less than 40% by weight of chromium is produced.

This method, however, is disadvantageous in that it takes much time to obtain molten metal containing the desired percentage of chromium, since chrome ore is, by nature, hard to reduce.

SUMMARY OF THE INVENTION

It is an object of the present invention to provide a method for melting and reducing chrome ore in a high speed.

In order to achieve the above-mentioned object, a method is provided, for melting and reducing chrome ore, by employing a reaction vessel capable of allowing top blowing and bottom blowing onto molten metal and decreasing pressure inside the reaction vessel, comprising the steps of:

supplying molten metal into the vessel;

charging chrome ore into the vessel;

charging carbonaceous material into the vessel;

decreasing the pressure therein to less than the atmospheric pressure; and blowing oxygen gas onto the molten metal while the molten metal is being stirred by a gas being introduced through a tuyere at the bottom of the vessel.

DETAILED DESCRIPTION OF THE PREFERRED EMBODIMENT

Figure 1:
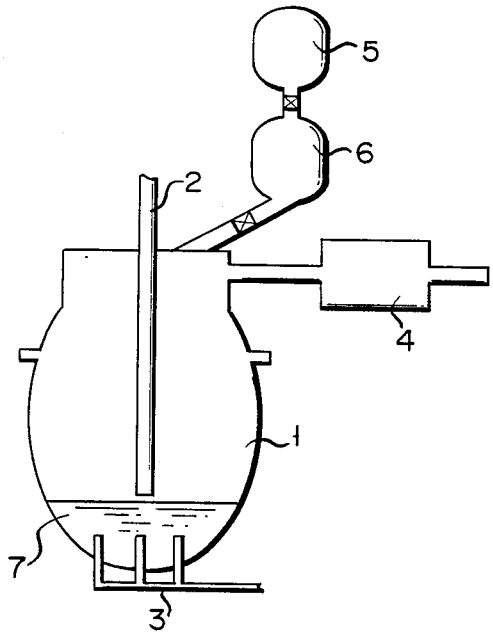
FIG. 1 is a schematic view showing an example of equipment employed for carrying out a method for melting and reducing chrome ore according to the present invention.

FIG. 1 is a schematic view showing an example of equipment employed for a method for melting and reducing chrome ore, according to the present invention.

Molten metal 7 is first supplied into reaction vessel 1. The pressure inside the vessel is decreased to 1 to 600 Torr, by use of a device 4 for exhausting gases. The decreased pressure is maintained. Lumps of chrome ore, of coal, and of flux are charged in through upper hopper 5 and lower hopper 6, onto the molten metal. Argon gas is blown in through tuyere 3. Oxygen gas is blown through lance 2 onto the molten metal, while the molten metal is being stirred by the argon gas. A portion of carbon contained in the charged lumps of coal produces CO gas, another portion dissolves into the molten metal, and the balance remains contained in slag. Thus, chrome ore is reduced by the reaction of the carbon contained in the molten metal and in the slag.

The reduction of chrome ore proceeds in accordance with the following formula:

$$Cr_2O_3+3C \rightarrow 2Cr+3CO$$

According to the present embodiment, since a decreased pressure or vaccum is maintained within reaction vessel 1, CO gas generated in the reduction process of chrome ore is removed from the vessel. Consequently, the reaction of the reduction is accelerated by this removal of gas. If the pressure is 600 Torr or less, it is effective for the reaction. If it is 300 Torr or less, it is even more effective. However, if it is less than 1 Torr, this radically raises the cost of investment in the equipment related to production on a commercial scale. Therefore, 1 to 600 Torr is appropriate, and 1 to 300 Torr more preferable.

In addition to the advantage of acceleration of the reaction according to the present invention, the reaction time thus shortened by the acceleration thereby reduces the stress on the equipment; the method of present invention can therefore extend the life of the equipment.

In the present embodiment, lumps of chrome ore are used. Chrome ore in powdered form can be used instead, wherein supplying the powder through lance 2 or tuyere 3 is deemed desirable. As another method charging the lumps of chrome ore through the upper part of reaction vessel 1 and also injecting the powdered chrome ore through lance 2 or tuyere 3 can be employed.

Lumps of coal are used as carbonaceous material, in the present embodiment. Lumps of coke, or powdered coal or coke can be substituted therefor. Charging of the lumps through the upper part of the vessel, and injecting of the powdered material through lance 2 or tuyere 3 is recommended. Moreover, to employ both the methods of charging the lumps through the upper part of the vessel and injecting the powder through lance 2 or tuyere 3 can be considered as an alternative method of supplying the carbonaceous material. The optimum amount of oxygen gas to be supplied ranges from 1.0 to 5.0 $Nm^3$/minute.T, where T represents one ton of molten metal. If the amount of oxygen gas supplied is more than 5.0 $Nm^3$/minute.T, more massive, and thus expensive equipment is required. On the other hand, if it is less than 1.0 $Nm^3$/minute.T, the speed of the reduction process becomes slow, and the amount of heat produced by combustion of the carbonaceous material becomes insufficient.

In the present embodiment, oxygen gas is blown in through the lance. Alternatively, it can be supplied through the tuyere, which has also the effect of stirring the molten metal. Moreover, oxygen gas can be blown in through both the lance and the tuyere.

Argon gas is blown in through the bottom, for stirring the molten metal, in the present embodiment. In place of argon gas, $N_2$ gas, $CO_2$ gas, or the process gas generated in the vessel during the melting and reducing reaction can be used. The appropriate amount of gas blown in through the bottom ranges from 0.1 to 1.5 $Nm^2$/minute.T. As the pressure decreases to close to 1 Torr, the gas necessary for stirring can be of a smaller amount. On the other hand, as the pressure becomes close to 600 Torr, a greater amount of gas is required. If, even in a low-pressure atmosphere (from 500 to 600 Torr), the amount of the gas blown in is more than 1.5 $Nm^3$/minute.T, this quantity is so excessive that a so-called hold-up phenomenon occurs wherein reacting molten metal is ejected out of the reaction vessel.

The present invention will be understood more readily with reference to the following examples; however, these examples are intended to illustrate the present invention and are not to be construed as limiting the scope thereof.

EXAMPLE 1

Figure 2:
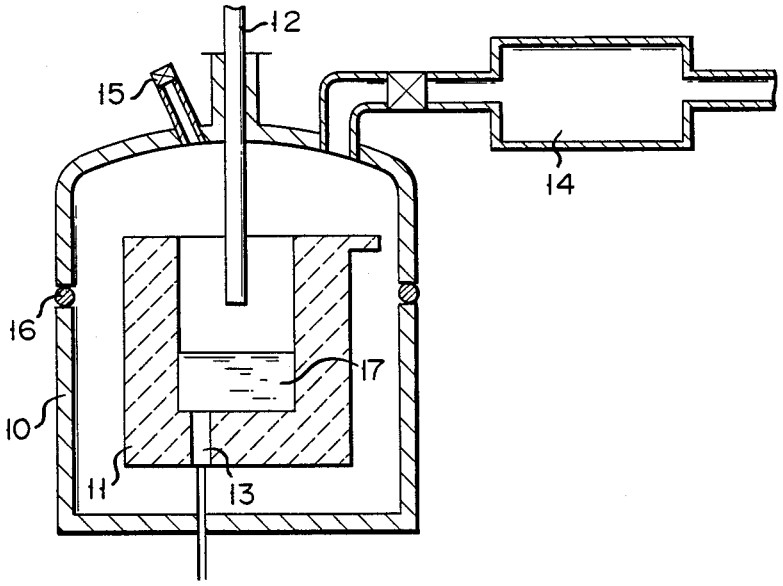
FIG. 2 is a schematic view showing an example of experimental equipment for performing another example of the method.

FIG. 2 illustrated schematically an example of experimental equipment employed for one example of the present invention. The equipment is composed of reactor 11 accommodated in vacuum vessel 10 which is connected with a device 14 for exhausting gases, so as to remove the gas from inside the reactor. The vaccum vessel consists of upper and lower parts; the upper part is equipped with a pipe leading to the device, and with inlet 15 for charging material; a gap between the upper and the lower parts is tightly sealed by sealing tool 16. Thus, the experimental equipment forms a tightly sealed system.

In this experiment, molten metal containing 5% carbon and 1.2% silicon was used; lumps of chrome ore, of coke, and of burnt lime were charged through inlet 15; oxygen gas was blown in through lance 2; and argon gas for stirring was injected through porous plug 13 provided at the bottom of the reactor.

Figure 3:
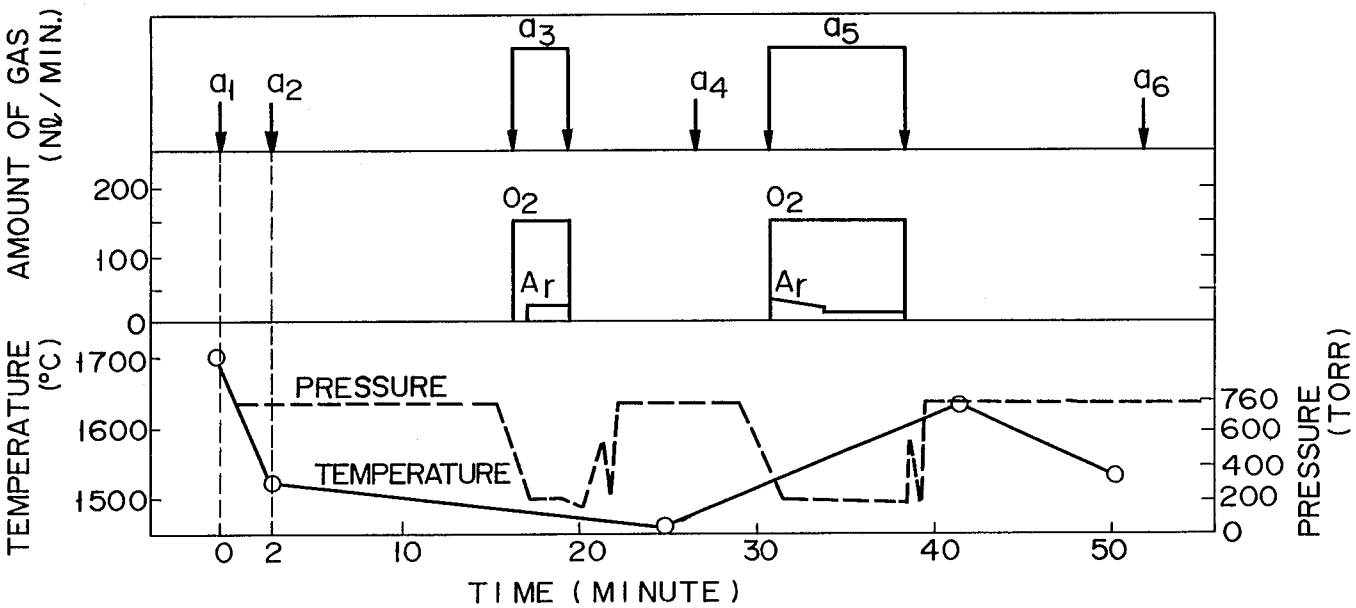
FIG. 3 is a graphical representation showing the operation progress of Example 1 of the method.

The operation progress of the example will now be described with reference to FIG. 3. The operation proceeded in 6 steps to a6.

a1: 40 kgs. of molten metal was supplied at the start;

a2: 1 kg. (25 kgs./T) of burnt lime and 2 kgs. (50 kgs./T) of coke were charged in 2 minutes after the start;

a3: Molten metal 17 was heated and molten slag was produced in the state wherein oxygen gas of 150 Nl/min. (3.75 $Nm^3$/min..T) and argon gas of 30 Nl/min. (0.75 $Nm^3$/min..T) were introduced onto the molten metal, under a pressure decreased to 200 Torr for 3 minutes after the lapse of 17 minutes;

a4: 2 kgs. (50 kgs./T) of chrome ore was charged in 28 minutes after the start;

a5: Chrome ore was reduced in the state wherein oxygen gas of 150 Nl/min. (3.75 $Nm^3$/min..T) and argon gas of 20 to 50 Nl/min. (0.5 to 1.25 $Nm^3$/min..T) were introduced onto the molten metal, under a pressure again decreased to 200 Torr for 8 minutes after the lapse of 29 minutes; and a6: The reduced metal was tapped out in 52 minutes after the start.

In the operation, the 8-minute reducing reaction increased the chromium content in the molten metal by 0.32%; the chromium content increased 0.04% per minute. The carbon content was almost constant throughout the operation, and the silicon content fell to a minute

EXAMPLE 2

The operation of another example according to the present invention was carried out, employing the same experimental equipment and the same molten metal as in Example 1.

Figure 4:
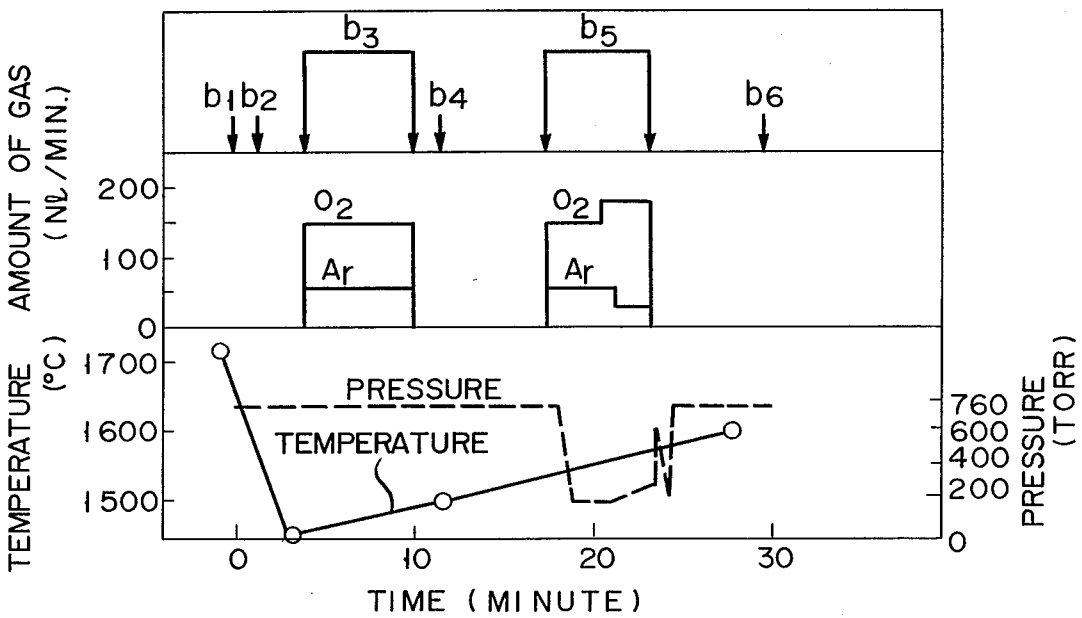
FIG. 4 is a graphical representation showing the operation progress of Example 2 of the method.

The operation progress of the example will now be described with reference to FIG. 4. The operation proceeded in 6 stages b1 to b6.

b1: 40 kgs. of molten metal was supplied at the start;

b2: 1 kg. (25 kgs./T) of burnt lime and 1.5 kgs. (37.5 kgs./T) of coke were charged in 2 minutes after the start;

b3: Molten metal 17 was heated and molten slag was produced in the state wherein oxygen gas of 150 Nl/min. (3.75 $Nm^3$/min..T) and argon gas of 50 Nl/min. (1.25 $Nm^3$/min..T) were introduced onto the molten metal, under an atmospheric pressure of 760 Torr for 6 minutes after the lapse of 3 minutes;

b4: 2 kgs. (50 kgs./T) of chrome ore and 1.5 kgs. (37.5 kgs./T) of coke were charged in 12 minutes after the start;

b5: Chrome ore was reduced in the state wherein oxygen gas of 150 to 180 Nl/min. (3.75 to 4.5 $Nm^3$/min..T) and argon gas of 20 to 50 Nl/min. (0.5 to 1.25 $Nm^3$/min..T) were introduced onto the molten metal, under the pressure decreased to 200 Torr; and b6: The reduced metal was tapped out in 30 minutes after the start.

In this operation, the 5-minute reducing reaction increased the chromium content in the molten metal by 0.43%; the chromium content increased 0.086% per minute. The increase in the chromium content of this example was larger than that of Example 1. This is perhaps because the initial temperature of the reduction stage increased by about 50, due to the time for heating the molten metal and producing molten slag having been longer.

In addition to the operation of Example 2 of the present invention, a comparative operation of reduction, with oxygen gas supplied under the same conditions as in Example 2, except for the atmospheric pressure was carried out. The comparative operation increased the chromium content by 0.15%, or 0.03% per minute. The reduction speed of the comparative operation was so slow as to correspond to about one third of that of Example 2. The reduction speed was considerably slow, even in comparison with that of Example 1.

EXAMPLE 3

An operation of one example according to the present invention, under a pressure decreased to 200 Torr, and another operation, under the atmospheric pressure were carried out, employing the same experimental equipment as in the cases of Examples 1 and 2, for comparison of the two operations.

At the beginning, the following materials were charged into reactor 11:

| | | |
|---|---|---|
| chrome ore; | 2 kgs. | (50 kgs./T) |
| burnt lime; | 1 kg. | (25 kgs./T) |
| silica; | 1 kg. | (25 kgs./T) |

For the first 5 minutes, chrome ore was reduced under the following conditions:

| | |
|---|---|
| pressure; | 760 Torr (atmospheric pressure) |
| oxygen gas introduced; | 150 Nl/min. (3.75 $Nm^3$/min. · T) |
| argon gas introduced; | 10 Nl/min. (0.25 $Nm^3$/min. · T) |

and

For the subsequent 5 minutes, chrome ore was reduced under the following conditions:

| | |
|---|---|
| pressure; | 200 Torr |
| oxygen gas introduced; | 150 Nl/min. 3.75 $Nm^3$/T) |
| argon gas introduced; | 10 Nl/min. (0.25 $Nm^3$/T) |

Figure 5:
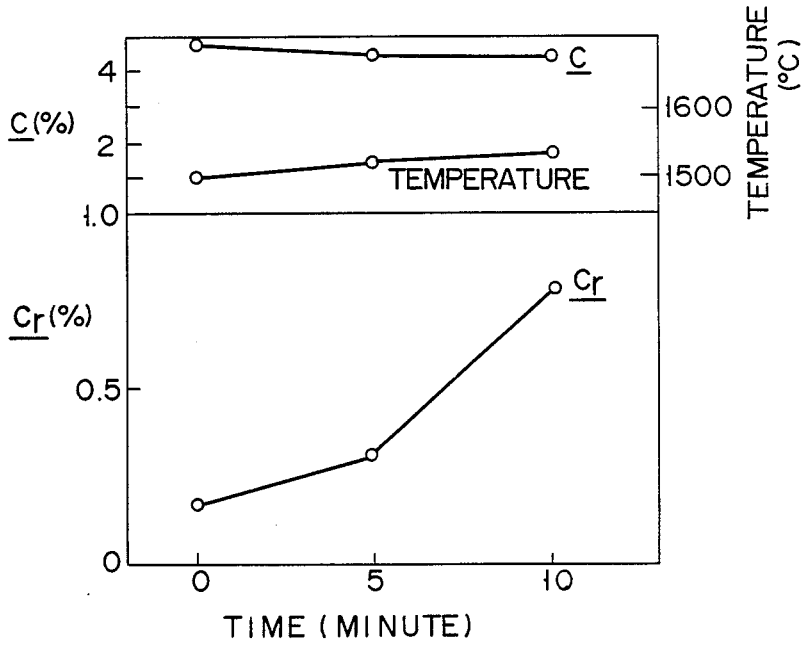
FIG. 5 is a graphical representation showing each change of chrome content, carbon content, and temperature, in relation to time.

The result is graphically illustrated in FIG. 5.

The first 5-minute operation carried out under the atmospheric pressure of 760 Torr increased the chromium content by 0.15%; the chromium content increased 0.03% per minute. The subsequent 5 minute operation under the pressure decreased to 200 Torr increased the chromium content by 0.5%; the chromium content increased 0.1% per minute. The comparison proves that the reduction, carried out at less than the atmospheric pressure, proceeded far faster. There was, however, almost no difference to be found with respect to carbon content and temperature in the two comparison operations.

What is claimed is:

1. A method for melting and reducing chrome ore, employing a reaction vessel including a lance disposed above molten metal in said vessel for top blowing and a tuyere disposed at the bottom of the vessel for bottom blowing through the molten metal and pressure means for decreasing pressure within said vessel, which comprises the steps of:

supplying molten metal into said vessel;

charging chrome ore into said vessel;

charging solid carbonaceous material into said vessel to substantially maintain the carbon content in the reaction vessel;

decreasing the pressure within the vessel through said pressure means to less than atmospheric pressure; and blowing oxygen gas onto said molten metal through the lance while said molten metal is being stirred by a gas which is introduced through the tuyere at the bottom of said vessel.

2. The method according to claim 1, wherein said step of decreasing the pressure includes decreasing the pressure to 1 to 600 Torr by the pressure means comprising a device for exhausting gases.

3. The method according to claim 2, wherein said step of decreasing the pressure includes decreasing the pressure to 1 to 300 Torr.

4. The method according to claim 1, wherein said step of charging chrome ore includes charging lumps of chrome ore through the upper part of said vessel.

5. The method according to claim 1, wherein said step of charging chrome ore includes injecting powdered chrome ore through a lance at the upper part of said vessel.

6. The method according to claim 1, wherein said step of charging chrome ore includes injecting powdered chrome ore through a tuyere at the bottom of said vessel.

7. The method according to claim 1, wherein said step of charging carbonaceous material includes charging lumps of carbonaceous material through the upper part of said vessel.

8. The method according to claim 1, wherein said step of charging carbonaceous material includes injecting powdered carbonaceous material through said lance.

9. The method according to claim 1, wherein said step of charging carbonaceous material includes injecting powdered carbonaceous material through said tuyere.

10. The method according to claim 1, wherein an oxygen gas is blown in an amount ranging from 1.0 to 5.0 $Nm^3$/min..T, where T represents one ton of molten metal.

11. The method according to claim 1, wherein the gas for stirring said molten metal, introduced through said tuyere includes a gas selected from the group consisting of Ar, $N_2$, and $CO_2$, and in an amount ranging from 0.1 to 1.5 $Nm^3$/min..T, where T represents one ton of molten metal.

12. The method according to claim 1, wherein the gas for stirring said molten metal, introduced through said tuyere includes a gas selected from the group consisting of Ar, $N_2$, and $CO_2$, and in an amount ranging from 0.3 to 1.5 $Nm^3$/min..T, where T represents one ton of molten metal.

13. The method according to claim 1, wherein the gas for stirring said molten metal, introduced through said tuyere includes a gas generated in the reaction within said vessel, and in an amount ranging from 0.1 to 1.5 ; $Nm^3$/min..T, where T represents one ton of molten metal.

14. The method according to claim 1, wherein the gas for stirring said molten metal, introduced through said tuyere includes a gas generated in the reaction within said vessel, and in an amount ranging from 0.3 to 1.5 $Nm^3$/min..T, where T represents one ton of molten metal.

* * * * *